United States Patent [19]

Beuther et al.

[11] 4,138,325

[45] Feb. 6, 1979

[54] PROCESS FOR CONVERSION OF GAS OIL TO ETHYLENE AND NEEDLE COKE

[75] Inventors: Harold Beuther, Cheswick; Joel D. McKinney, Pittsburgh; Harold E. Swift, Gibsonia, all of Pa.

[73] Assignee: Gulf Research & Development Company, Pittsburgh, Pa.

[21] Appl. No.: 863,403

[22] Filed: Dec. 22, 1977

[51] Int. Cl.[2] ..... C10G 37/06; C07C 3/30

[52] U.S. Cl. ..... 208/50; 260/683 R

[58] Field of Search ..... 208/50; 260/683 R

[56] References Cited

U.S. PATENT DOCUMENTS

| | | | |
|---|---|---|---|
| 3,556,987 | 1/1971 | Zimmerman et al. | 208/93 |
| 3,617,495 | 11/1971 | Zimmerman et al. | 208/50 |
| 3,839,484 | 10/1974 | Zimmerman et al. | 260/683 R |
| 3,878,088 | 4/1975 | Nahas et al. | 208/50 |
| 4,039,429 | 8/1977 | Klinken et al. | 208/50 |
| 4,061,562 | 12/1977 | McKinney et al. | 260/683 R |

*Primary Examiner*—C. Davis

[57] ABSTRACT

A process for the conversion of gas oil to a naphtha pyrolysis feedstock and needle coke comprising thermally cracking the gas oil to produce a product comprising cracked naphtha and aromatic tar oil, delay coking said aromatic tar oil to produce needle coke and coker naphtha, and hydrotreating said cracked naphtha and said coker naphtha at a temperature at least 50° F. (28° C.) lower than the temperature in the thermal cracking and coking zones to avoid hydrocarcking reactions and to produce a hydrogenated naphtha containing at least 10 volume percent of cycloparaffins. Said hydrogenated naphtha is thereupon passed through a pyrolysis zone without added molecular hydrogen and without a catalyst operated at a temperature between 1,300 and 2,300° F. (704 and 1,260° C.) and a residence between 0.05 and 2 seconds to produce a product containing ethylene. The ethylene yield can be increased by adding a sulfur compound to the hydrogenated naphtha stream flowing to the pyrolysis zone.

17 Claims, 1 Drawing Figure

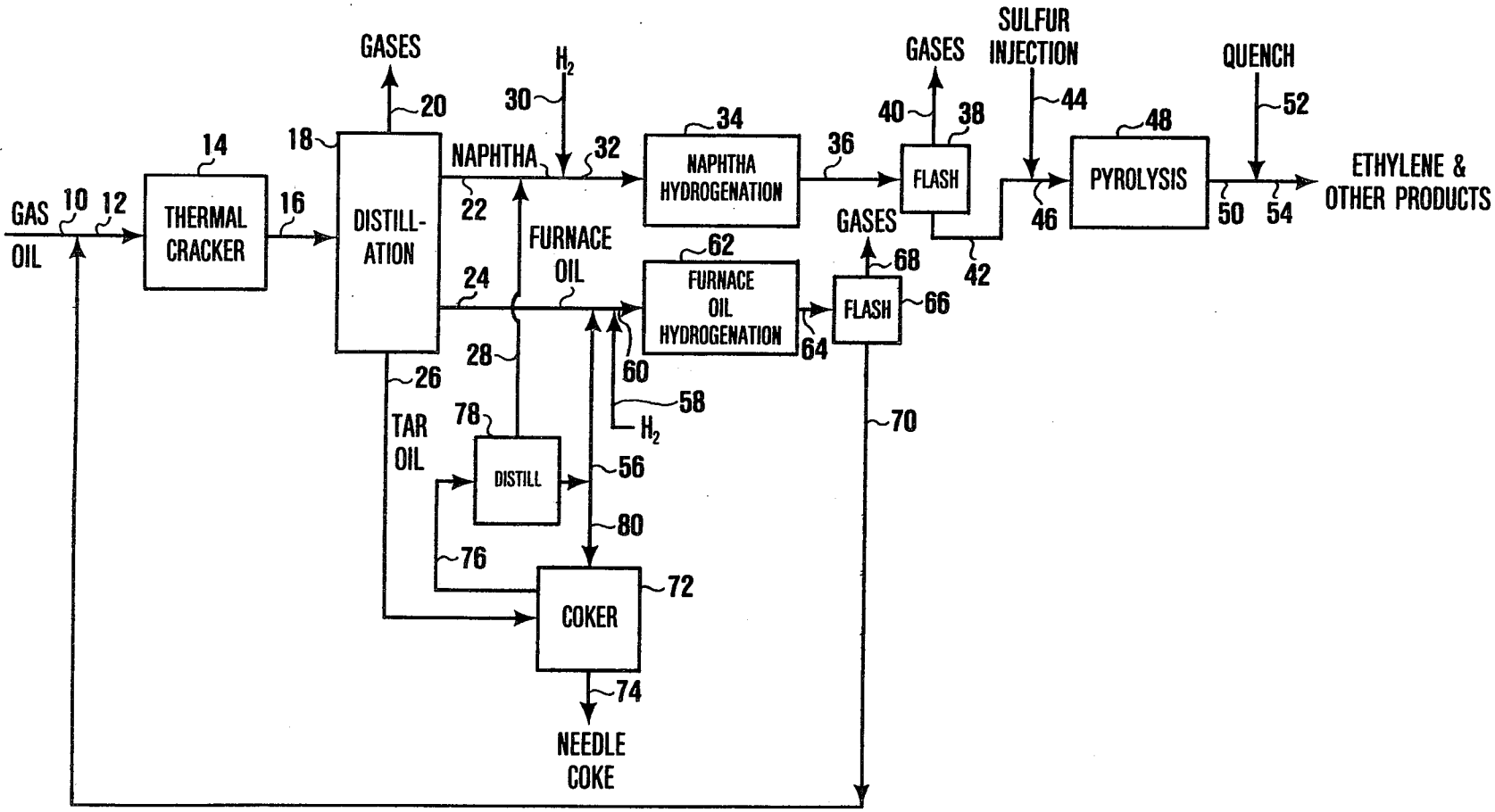
GAS
OIL
10
12
THERMAL CRACKER
14
16
DISTILL-ATION
18
GASES
20
NAPHTHA
22
FURNACE OIL
24
26
TAR OIL
28
$H_2$
30
32
NAPHTHA HYDROGENATION
34
36
FURNACE OIL HYDROGENATION
62
64
60
58
$H_2$
56
80
DISTILL
78
76
COKER
72
74
NEEDLE COKE
FLASH
38
GASES
40
42
FLASH
66
GASES
68
70
SULFUR INJECTION
44
46
PYROLYSIS
48
QUENCH
52
50
54
ETHYLENE & OTHER PRODUCTS

PROCESS FOR CONVERSION OF GAS OIL TO ETHYLENE AND NEEDLE COKE

This invention relates to a process involving low hydrogen consumption for the conversion of a large proportion of a distillate oil boiling above the naphtha range to a naphtha pyrolysis feedstock which is relatively free of coke formers.

In the process of this invention heavy gas oil is converted to both thermally cracked naphtha and to coker naphtha, and to needle coke. Thermally cracked naphtha and coker naphtha have relatively high olefinic and aromatic contents and are therefore unsatisfactory pyrolysis feedstocks unless they are first hydrotreated. While it is known that a stream of normal and iso non-cyclic paraffins, such as pentanes, constitutes a high quality pyrolysis feedstock, providing high ethylene and low coke yields, a stream comprising cracked naphtha and coker naphtha constitutes a lower quality pyrolysis feedstock because such naphtha contains a significant amount of olefins and aromatics which are more refractory than paraffins and have a greater tendency to be converted to coke at pyrolysis temperatures.

Cracked naphtha and coker naphtha can be upgraded considerably as pyrolysis feedstocks by catalytic hydrogenation. The hydrogenation operation converts olefins to paraffins while aromatics are converted to cycloparaffins, thereby improving the cracking susceptibility and diminishing the coking susceptibility of these materials. The conditions of the hydrogenation operation are sufficiently mild that little or no opening of cycloparaffinic rings or other hydrocracking occurs. For example, not more than 10 or 20 volume percent of the naphtha is converted to material boiling below the IBP of the total naphtha feedstock during the naphtha hydrotreating operation.

The cracked and coker naphtha pyrolysis feedstock of this invention primarily comprises materials boiling within the range 80 to 450° F. (27 to 232° C.), and especially within the range 110 to 185° C.). Even if cracked and coker naphthas are hydrogenated, because of low octane number they are not acceptable for use as gasoline unless they are leaded, and leaded fuels cannot be employed in late model automobile engines. Therefore, the use of hydrogenated cracked and coker naphthas as pyrolysis feedstocks represents an important present day use of these naphthas.

While it would be expected that the conversion of the aromatic content of naphthas to cycloparaffins via hydrogenation would constitute an upgrading of such naphthas as pyrolysis feedstocks, it would also be expected that without hydrocracking to open the cycloparaffinic ring structures the hydrogenated naphthas would be inferior to non-cyclic paraffins as pyrolysis feedstocks. It is shown below that cycloparaffinic hydrogenated naphtha pyrolysis feedstocks can be upgraded nearly to the status of non-cyclic paraffinic pyrolysis feedstocks without recourse to hydrocracking to open cycloparaffinic ring structures by adding a sulfur-containing compound thereto. It has been found that injecting a sulfur-containing compound increases ethylene selectivity during pyrolysis of a hydrogenated naphtha containing more than 10, 20 or 30 volume percent of cycloparaffins. The introduction of an extraneous sulfur-containing compound upgrades a cycloparaffinic hydrogenated naphtha feedstock nearly to the quality of a non-cyclic feedstock without consuming the hydrogen that would otherwise be required to hydrocrack the cycloparaffinic structures to non-cyclic paraffins.

Hydrogenated thermal and coker naphthas generally contain less than about one volume percent of olefins plus aromatics and less than about 10 ppm by weight of sulfur. These hydrogenated naphthas are upgraded as pyrolysis feedstocks by adding a sulfur compound so that there is more than 20 ppm by weight of sulfur in the pyrolysis zone. For example, the sulfur content is increased so that there is between about 20 and 1,000 ppm by weight of sulfur, generally; between about 50 and 800 ppm by weight of sulfur, preferably; and between about 75 and 500 ppm by weight of sulfur, most preferably, based on hydrogenated naphtha.

Any suitable sulfur compound can be added. A suitable but non-limiting list of sulfur compounds includes hydrogen sulfide, organo-mercaptans such as methanethiol, ethyl mercaptan, propyl mercaptan, n-butyl mercaptan, octyl mercaptan, hexyl mercaptan, and the like; aryl mercaptans such as phenyl mercaptan, naphthyl mercaptan, and the like; organo-sulfides such as methylthioethane, phenylthioethane, carbon disulfide, and the like; the organo-sulfoxides such as dimethyl sulfoxide, methyl sulfonyl ethane, and the like; organosulfones such as diethyl sulfone, methyl sulfonyl ethane, phenyl sulfonyl, ethane, and the like.

The pyrolysis operation is performed without added molecular hydrogen and without a catalyst and can be carried out in a coil furnace. The pyrolysis operation does not require the use of inert hot solids as a heat source. However, if desired, the pyrolysis operation can be performed in a riser without a furnace, utilizing entrained catalytically inert hot solids as a heat source.

The temperature in the pyrolysis zone is between about 1,300 and 2,300° C. ), generally, between about 1,400 and 2,000° F. (760 and 1,093° C.), most preferably. Immediately upon leaving the pyrolysis zone, the product stream is quenched to a temperature below 1,300° F. (704° C.). A quench temperature between about 890 and 1,300 (477 and 704° C.) is suitable.

A dispersant gas, preferably steam, is supplied to the pyrolysis coil, if desired, in any amount up to about 2 pounds per pound (908 gm. per gm.) of hydrocarbon feed. Although the use of steam favorably influences ethylene yield and selectivity, it is a costly factor in cracker operation and the amount of steam required can be reduced by the addition of a sulfur compound in accordance with the invention.

The pressure in the pyrolysis coil should be adequate to force the riser effluent stream through downstream product separation equipment. The pressure can be between about 3 and 100 psi (0.2 and 7 kg/cm$^2$), generally, and between about 5 and 50 psi (0.35 and 3.5 kg/cm$^2$), preferably. A pressure above about 15 psi (1.05 kg/cm$^2$) will usually be required. The coil residence time can be between about 0.5 and 2 seconds, generally, or between about 0.5 and 0.5 seconds, preferably. If a riser employing hot solids is employed, the operating conditions will be similar to those employed for coil furnace cracking except that pyrolysis heat is supplied by hot, inert solids rather than by a furnace. During pyrolysis, coke is deposited on the hot solids which are then passed to a combustion zone where the coke is burned from the solids, thereby reheating the solids for recycle to the pyrolysis zone.

An enhanced ethylene yield is achieved by employing sulfur injection even when ethane or other cracked products are not recycled, although ethane and other cracked products can be recycled, if desired. In order to encourage the pyrolysis dehydrogenation of ethane to ethylene, molecular hydrogen is not added to the pyrolysis zone and the pyrolysis operation is performed without any hydrogenation catalyst or other catalytic entity. A reason for operating the pyrolysis zone at a pressure which is as low as is practical is to maintain the pressure of molecular hydrogen produced in the pyrolysis operation at a low level. A low hydrogen pressure advantageously discourages hydrogenation of ethylene to ethane so that the once-through yield of ethylene on a weight basis will be 3, 4 or 5 times, or more, than the yield of ethane.

As indicated above, it is known that non-cyclic paraffins constitute a high quality pyrolysis feedstock. A stream containing normal or iso non-cyclic paraffins from the $C_2$ to $C_5$ group constitutes a particularly suitable pyrolysis feedstock. Pyrolysis of these materials is known to provide a high ethylene selectivity with a low coke yield. A low coke yield is particularly important operationally because deposits of coke upon the inner wall of a pyrolysis coil interferes with heat transfer across the coil, requiring frequent downtimes for reaming or combustion of the coke from the coil, thereby reducing the length of the pyrolysis cycle. Because lower quality pyrolysis feedstocks, such as higher molecular weight or cyclic materials, produce a higher coke yield, such materials generally exert a deleterious effect when blended with a feed stream comprising $C_2$ to $C_5$ non-cyclic paraffins. The higher coke yield resulting from introducing these materials to a $C_2$ to $C_5$ paraffinic feedstock shortens the process cycle and therefore tends to reduce the operational attractiveness of the non-cyclic paraffin feedstock.

Data presented below show that at a given cracking temperature, the pyrolysis of pentane results in a lower coke yield than the pyrolysis of hydrogenated coker naphtha. This finding is expected because of the presence of a higher level of cycloparaffins in a hydrogenated coker naphtha stream than in a pentane stream. However, data presented below show that the addition of a sulfur compound to a hydrogenated coker naphtha pyrolysis feedstock reduces the coke yield obtained upon pyrolysis to about the same coke yield as is obtained upon pyrolysis of pentanes at a comparable temperature.

Data presented below indicate that hydrogenated cracked or coker naphtha containing more than 10, 20 or 30 volume percent of cycloparaffins together with an added sulfur compound can be blended with a normal or isoparaffinic pyrolysis feedstock boiling in the naphtha range containing less than 10 volume percent of cycloparaffins or with a stream containing paraffins from the $C_2$ to $C_5$ group containing less than 10 volume percent cycloparaffins without significantly increasing the coke yield. It is because of the addition of the sulfur compound that the coke yield, and therefore the pyrolysis cycle length for a given throughput, is about the same when employing the blended feedstock as when employing the low cycloparaffinic feedstock alone. Furthermore, the sulfur compound enhances the ethylene yield from the hydrogenated naphtha portion of the blend. In addition, the yield of valuable aromatics, including benzene, toluene and xylene, is higher from the blend than it is from the low cycloparaffinic feedstock alone, apparently because some of the cycloparaffinic content of the hydrogenated naphtha is aromatized to these aromatics. Thereby, use of the blend improves the mix of valuable products from the process.

The method of this invention involves low hydrogen consumption in the preparation of a naphtha pyrolysis feedstock from a distillate oil boiling above the naphtha range, such as a petroleum heavy gas oil, wherein a large proportion of the distillate oil is converted to naphtha pyrolysis feedstock which is relatively free of coke-formers. This method involves first thermally cracking the higher boiling oil at a relatively high temperature in the absence of added molecular hydrogen and without a catalyst to obtain a mixture including a cracked naphtha, a furnace oil and an aromatic tar whose components mostly boil in the range of about 800 to 1,200° F. (427 to 649° C). In order to avoid hydrocracking reactions, the cracked naphtha stream is thereupon hydrogenated at a temperature lower than the thermal cracking temperature. The furnace oil is hydrotreated and recycled to the thermal cracking step for conversion to naphtha. The aromatic tar is passed to a delayed coker for the production of needle coke, whereby coke-forming material is diverted from the pyrolysis unit and, at the same time, coker naphtha is produced to enhance the pyrolysis naphtha feed stream. The naphtha stream which is passed to the hydrogenation step includes both cracked naphtha and coker naphtha and contains olefins, naphthenes and aromatics. This naphtha stream is hydrotreated at a temperature below both the cracking and coking temperatures, i.e. at a temperature at least 50° F. (28° C.) below the temperatures in the thermal cracking and coking zones, whereby hydrogenolysis reactions are substantially avoided and hydrogen is conserved. In this manner, the non-cyclic olefinic materials in the cracked naphtha and coker naphtha streams are converted to cycloparaffins, without any significant opening of ring structures.

The thermal tar passed to the coker is converted therein to commercially valuable needle coke, coker naphtha and furnace oil. Because the thermal cracking step is performed without added hydrogen, the aromatic nature of the thermal tar is preserved and therefore the thermal tar constitutes a high quality coker feedstock. As indicated above, passage of the cracked heavy oil to a coker unit prevents coke formers from entering the pyrolysis unit and shortening the cycle therein. In addition, it increases the pool of naphtha available as pyrolysis feedstock by providing a pyrolysis feedstock comprising both thermal cracked naphtha and coker naphtha derived from the same gas oil source.

The coker naphtha has a composition similar to that of the cracked naphtha and therefore the blend of the coker naphtha and cracked naphtha constitutes an advantageous feedstock for the naphtha hydrogenation operation which is performed at a lower temperature than both the temperature of the coker operation and the temperature of the thermal cracker. Furnace oil produced in both the thermal cracking and coking steps is hydrotreated and recycled to the thermal cracking step for conversion to naphtha. In this process, the entire gas oil feedstock is converted to naphtha for the pyrolysis unit, except for a high boiling aromatic stream which is highly susceptible to coking which is converted to needle coke, a commercially valuable form of coke.

Becase the naphtha hydrogenation operation is performed at a sufficiently low temperature to avoid hydrocracking reactions, a saturated naphtha comprising cyclic constituents is prepared without consuming hydrogen by opening of ring structures. Data are presented below which show that a hydrogenated cracked naphtha and/or coker naphtha stream wherein the cyclic structures are retained can be upgraded as a pyrolysis feedstock to the quality of a non-cyclic paraffinic feedstock by the addition of a sulfur compound.

Table 1 shows the results of once through pyrolysis tests employing three different feedstocks, including a stream comprising pentanes, a stream comprising non-hydrogenated coker gasoline and a stream comprising hydrogenated coker gasoline. These tests were performed at the various temperatures indicated in Table 1 in a coil passing through a furnace with a 0.75 weight ratio of steam to hydrocarbon. The pentane feedstock contained 5.46 volume percent of cycloparaffins, the remainder being non-cyclic $C_5$ paraffins. The composition of the coker gasoline was typical of coker and thermally cracked gasolines. These gasolines generally contain about 5 to 8 volume percent aromatics, about 44 to 50 volume percent olefins, and the rest naphthenes. The hydrogenation conditions used in preparing the hydrogenated coker naphtha feedstock included a temperature of 688° F. (364° C.), a pressure of 1250 psi (87.5 kg/cm$^2$ ), a LHSV of 1.0, a gas rate of 7500 SCF/B (135 SCM/100L) of a stream comprising 80 percent hydrogen, a hydrogen consumption of 600 SCF/B (10.8 SCM/100L). The non-hydrogenated coker gasoline had an over point of 131° F. (55° C.), an end point of 336° F. (169° C.), and a mean average boiling point of 219° F. (104° C.). The hydrogenated coker gasoline had an over point of 131° F. (55° C.), an end point of 349° F. (176° C.), and a mean average boiling point of 223° F. (106° C.). Therefore, very little hydrocracking occurred during the hydrotreatment and essentially no material was cracked to a temperature below the IBP of the feedstock. The composition of the hydrogenated coker gasoline is shown in Table 2. .

Table 2

| | Volume Percent |
|---|---|
| Total paraffins | 65.3 |
| Monocycloparaffins | 32.6 |
| Dicycloparaffins | 1.6 |
| Aromatics | 0.5 |

Table 2 shows that the hydrogenated coker gasoline comprised a total of 34.2 volume percent cycloparaffins, and was almost entirely paraffinic in nature. Therefore, the hydrotreatment operation accomplished saturation of substantially all unsaturated materials in the coker gasoline without essentially any hydrocracking, as indicated by an essentially constant mean average boiling point.

Table 1

PYROLYSIS DATA

| | Hydrogenated Coker Gasoline | | | | Non-Hydrogenated Coker Gasoline | Pentanes | | | |
|---|---|---|---|---|---|---|---|---|---|
| Temp. ° C. (° F.) | 836 (1537) | 847 (1557) | 858[d] (1576) | 877 (1611) | 832 (1530) | 834 (1533) | 843 (1550) | 853 (1567) | 864 (1587) |
| $H_2$[a] | 0.96 | 0.99 | 1.07 | 1.19 | 0.80 | 0.93 | 1.02 | 1.12 | 1.19 |
| $CH_4$ | 15.35 | 16.28 | 17.61 | 19.03 | 14.34 | 16.90 | 18.88 | 20.66 | 22.02 |
| $C_2H_2$ | 0.33 | 0.37 | 0.44 | 0.57 | 0.24 | 0.33 | 0.41 | 0.49 | 0.51 |
| $C_2H_4$ | 27.97 | 28.66 | 29.88 | 29.56 | 21.93 | 27.08 | 29.29 | 31.74 | 32.82 |
| $C_2H_6$ | 5.10 | 4.87 | 4.87 | 4.73 | 4.84 | 5.71 | 5.72 | 5.84 | 5.59 |
| $C_3H_4$ | 0.92 | 1.20 | 0.96 | 0.89 | 0.72 | 0.58 | 0.67 | 0.76 | 0.85 |
| $C_3H_6$ | 15.76 | 13.90 | 11.89 | 9.32 | 12.90 | 19.22 | 17.99 | 17.48 | 15.04 |
| $C_3H_8$ | 0.25 | 0.22 | 0.18 | 0.22 | 0.25 | 0.23 | 0.22 | 0.19 | 0.16 |
| $C_4H_6$ | 4.74 | 4.45 | 3.97 | 3.01 | 3.83 | 4.29 | 3.81 | 3.55 | 4.00 |
| i-$C_4H_8$ | 2.32 | 1.66 | 1.43 | 0.92 | 2.13 | 5.62 | 4.42 | 3.63 | 3.27 |
| $C_4H_8$ | 1.13 | 0.68 | 0.35 | 0.18 | 0.68 | 1.38 | 0.48 | 0.67 | 0.50 |
| RPG | 19.25 | 18.03 | 19.51 | 21.06 | 21.93 | 15.00 | 14.10 | 11.36 | 11.18 |
| FO[b] | 2.36 | 2.70 | 3.91 | 4.77 | 5.97 | 0.78 | 1.21 | 1.55 | 1.89 |
| $C_6H_6$[c] | 8.72 | 8.84 | 10.99 | 11.98 | 8.24 | 4.53 | 5.82 | 5.41 | 5.02 |
| $C_7H_8$[c] | 3.51 | 3.45 | 3.94 | 4.07 | 6.74 | 1.69 | 2.04 | 2.09 | 2.34 |
| $C_8H_{10}$[c] | 0.53 | 0.49 | 0.46 | 0.53 | 2.72 | 0.24 | 0.29 | 0.30 | 0.33 |
| Coke | 2.33 | 5.10 | 3.30 | 4.13 | 8.55 | 0.96 | 3.06 | 3.22 | 2.46 |

[a]Values in weight percent
[b]Fuel Oil
[c]Values contained in RPG (raw pyrolysis gasoline).
[d]This is the only test utilizing sulfur-spiking. 0.024 weight percent (240 ppm) of sulfur was added in the form of a thiophene.

Table 1 shows that the pyrolysis of hydrogenated coker gasoline at 836° C. (1,537° F.) results in considerably more ethylene production and considerably less coke as compared to pyrolysis of non-hydrogenated coker gasolie at the comparable temperature of 832° C. (1,530° F.). The coke yield in the test employing the non-hydrogenated coker gasoline was so great as to require an early termination to the pyrolysis test with that feedstock.

Table 1 shows that in general the coke yield from the hydrogenated coker gasoline is higher than it is from a pentane feedstock at comparable temperatures, but that spiking of the hydrogenated coker gasoline feedstock with 0.024 weight percent of sulfur (240 ppm by weight) in a pyrolysis test at 858° C. (1,576° F.) reduced the coke yield to a level which is nearly the same as that obtained with a pentane feedstock at the comparable temperature of 853° C. (1,567° F.).

It is further shown in Table 1 that sulfur spiking of the hydrogenated coker gasoline feedstock increases ethylene yield, i.e., it increases product selectivity towards ethylene. In this regard, Table 1 shows that in the case of both the pentane feedstock and the hydrogenated coker gasoline feedstock, ethylene yield increases progressively with increases in pyrolysis temperature, the only exception being the single test in which sulfur spiking was employed with a hydrogenated coker gasoline feedstock. In that test, an ethylene yield of 29.88 weight percent was achieved at a pyrolysis temperature of 858° C. (1,576° F.), and this ethylene yield is higher than the 29.56 weight percent ethylene yield achieved at a higher pyrolysis temperature of 877° C. (1,611° F.) employing a similar feedstock without sulfur spiking. This shows that sulfur spiking improved ethylene selectivity during pyrolysis cracking of the hydrogenated coker gasoline.

Table 2 shows that about one-third of the hydrogenated coker gasoline feedstock is cycloparaffinic, while it is stated above that only 5.46 volume percent of the pentane feedstock is cycloparaffinic. It is known that cycloparaffins are inferior to non-cyclic paraffins as an ethylene feedstock, in terms of both ethylene selectivity and coke formation. Furthermore, the boiling range of hydrogenated coker gasoline is higher than that of pentanes and it is known that relatively high boiling paraffins are inferior to lower boiling paraffins as an ethylene feedstock. In spite of the predicted high superiority of the pentane feedstock based upon these considerations, the 29.88 weight percent ethylene yield obtained upon pyrolysis of the hydrogenated coker gasoline feedstock at 858° C. (1,576° F.) employing sulfur spiking compares favorably with the 31.74 weight percent ethylene yield obtained with the pentane feedstock at the comparable pyrolysis temperature of 853° C. (1,567° F.). Even though the coke yield from the hydrogenated coker gasoline in the other tests is generally considerably higher than the coke yield from the pentane feedstock at comparable temperatures, the 3.30 weight percent coke yield obtained with the hydrogenated coker gasoline feedstock in the test at 858° C. (1,576° F.) employing sulfur spiking is essentially the same as the 3.22 weight percent coke yield obtained with the pentane feedstock in the test at the comparable temperature of 853° C. (1,567° F.). Since it is the magnitude of the coke yield that establishes the length of a cracking cycle in a coil pyrolysis operation, it is apparent that a sulfur-spiked hydrogenated coker gasoline feedstock can be blended with a pentane feedstock and thereby replace a portion of the pentane feedstock on an equal weight basis without essentially any reduction in cycle length due to coking.

Table 1 shows that a higher yield of aromatics was obtained from pyrolysis of the sulfur-spiked hydrogenated coker gasoline feedstock at 858° C. (1,576° F.) as compared to pyrolysis of pentanes at the comparable temperature of 853° C. (1,567° F.), indicating that the cyclic paraffinic content in the hydrogenated coker gasoline induces a much higher yield of aromatics than is produced with the less cyclic pentane feedstock. While aromatics are frequently coke precursors, in the sulfur-spiking test of Table 1 conversion of the cycloparaffins was selective to aromatics and non-selective to coke. As long as aromatic products do not polymerize to coke, their production is advantageous since benzene, toluene and xylene are valuable commercial byproducts of the process. Thereby, replacement of a portion of pentane feedstock with hydrogenated coker gasoline on an equal weight basis at a given pyrolysis temperature can tend to diversify the mix of valuable products without reducing the cycle life of the pentane cracking operation.

The process of this invention is illustrated in the drawing. As shown in the drawing, a distillate gas oil feed stock comprising mostly components boiling between about 650 and 1,000° F. (343 and 538° C.) is passed through lines 10 and 12 to thermal cracker 14. Thermal cracker 14 is operated without added molecular hydrogen and without a catalyst at temperatures between about 750 and 1,000° F. (399 to 538° F.), generally, or between about 790 and 950° F. (421 to 510° C.), preferably. The pressure can be 100 to 5,000 psi (7 to 350 kg/cm$^2$), generally, and 100 to 2,500 psi (7 to 175 kg/cm$^2$), preferably. The oil residence time in thermal cracker 14 can be 0.0014 to 5 hours, generally, or 0.3 to 3 hours, preferably. One suitable thermal cracking process is described in U.S. Pat. No. 4,005,006.

Thermal cracker effluent in line 16 is passed to distillation column 18 from which gases comprising $C_4$ or $C_5$ and lighter hydrocarbons are removed through line 20, a naphtha stream is removed through line 22, a furnace oil stream is removed through line 24 and from which a stream of aromatic tar oils containing components boiling between about 800 and 1,200° F. (427 and 649° C.), is removed through line 26.

The thermally cracked naphtha in line 22, together with coker naphtha entering through line 28, from a source explained below, as well as molecular hydrogen entering through line 30, are passed through line 32 to catalytic naphtha hydrogenation zone 34. The combined naphtha stream comprises mostly material boiling within the range 80 to 450° F. (27 to 232° C.). A suitable catalyst for zone 34 comprises tungsten and/or molybdenum and a Group VIII metal on a highly porous, non-cracking supporting material. Alumina is the preferred supporting material but other porous, non-cracking supports, such as magnesia-alumina, can be employed. Tungsten and/or molybdenum is preferably, but not necessarily, the supported catalytic entity present in greatest amount and can generally comprise about 1 to about 25 weight percent of the catalyst, or preferably, can comprise about 15 to 22 weight percent of the catalyst. The Group VIII metal is preferably nickel and can comprise generally about 1 to about 25 weight percent of the catalyst, or preferably, about 3 to about 22 weight percent of the catalyst. These metal contents are based on elemental metal. However, the catalytic metals will generally be present first as metal oxides and will be converted in part to metal sulfides before or during use. In order to avoid hydrocracking reactions, the hydrogenation temperature in zone 34 is at least about 50° F. (28° C.) lower than the temperature in thermal cracker 14. Suitable hydrogenation conditions for naphtha hydrogenation zone 34 include a temperature in the range 500 to 850° F. (260 to 454° C.), generally, and 625 to 700° F. (329 to 371° C.), preferably; and a hydrogen pressure in the range 400 to 2500 psi (28 to 175 kg/cm$^2$), generally, and 500 to 1500 psi (35 to 105 kg/cm$^2$), preferably. The liquid hourly space velocity can be between 0.25 and 4 or, preferably, between 0.5 and 1.5. The circulation rate of hydrogen can be between 2,000 and 10,000 SCF/B (36 and 180 SCM/100L), generally, or, preferably, between 3,000 and 7,000 SCF/B (54 and 126 SCM/100L). Hydrogen consumption can be between about 400 and 1,000 SCF/B (7.2 and 18 SCM/100L), generally, but more usually will be between about 500 and 800 SCF/B (9 and 14.4 SCM/100L).

The cracked naphtha and coker naphtha stream in line 32 flowing to naphtha hydrogenation zone 34 will usually contain more than about 35 volume percent of olefins plus aromatics. The stream leaving hydrogenation zone 34 in line 36 will contain less than 5 volume percent of olefins plus aromatics, generally, and preferably less than 2 volume percent of olefins plus aromatics. Very little hydrocracking or ring opening occurs in naphtha hydrogenation zone 34 so that naphthenes will be generally converted to cycloparaffins rather than to non-cyclic paraffins. The hydrogenated naphtha in line 36 will generally contain at least 10 or 20 volume percent of cycloparaffins. The oil will be desulfurized under the hydrogenation conditions in zone 34 so that the hydrogenated naphtha in line 36 will contain less than 10 ppm by weight of sulfur, or even less than 5 ppm by weight of sulfur.

The hydrogenated naphtha stream in line 36 is passed to flash chamber 38 from which gases, including hydrogen, hydrogen sulfide and ammonia are removed through line 40, and from which a naphtha stream is removed through line 42. The hydrogen in line 40 can be purified and recycled. A sulfur compound is added through line 44 to the hydrogenated naphtha stream so that the resulting mixture in line 46 contains more than 20 ppm by weight of sulfur, based on the hydrogenated naphtha. The sulfur-spiked stream in line 46 flows without added molecular hydrogen to pyrolysis zone 48. Pyrolysis zone 48 utilizes a coil within a furnace to accomplish pyrolysis or thermal cracking of the hydrogenated naphtha stream at a temperature between 1,300 and 2,300° F. (704 and 1,260° C.). Cracked products in line 50 are quenched immediately upon leaving zone 48 by a quench liquid, such as steam, in line 52 to a temperature below 1,300° F. (704° C.). A pyrolysis effluent stream containing ethylene and other cracked products is discharged through line 54 to a product recovery system, not shown.

The thermal furnace oil stream in line 24, together with coker furnace oil entering through line 56, from a source explained below, and hydrogen entering through line 58, are passed through line 60 to furnace oil catalytic hydrogenation zone 62. The catalyst in zone 62 comprises at least one Group VI metal and at least one Group VIII metal on a suitable porous non-cracking support, such as alumina or magnesia-alumina. Examples of suitable catalysts for hydrogenation zone 62 include nickel-cobalt-molybdenum, cobalt-molybdenum, nickel-tungsten and nickel-molybdenum. Suitable hydrogenation conditions include a temperature range of 650 to 800° F. (343 to 427° C.), generally, and 670 to 800° F. (354 to 427° C.), preferably; a hydrogen pressure in the range of 500 to 1800 psi (35 to 126 kg/cm$^2$), generally, and 800 to 1500 psi (56 to 105 kg/cm$^2$), preferably; a liquid hourly space velocity in the range of 0.5 to 5, generally, and 0.7 to 2 preferably; and a hydrogen circulation range of 1000 to 8000 SCF/B (18 to 144 SCM/100L), generally, and 2000 to 3000 SCF/B (36 to 54 SCM/100L), preferably. Hydrogen consumption can be between about 150 and 700 SCF/B (2.7 and 12.6 SCM/100L).

An effluent stream leaves furnace oil hydrogenation zone 62 through line 64 and enters flash chamber 66 from which a gaseous hydrogen stream containing hydrogen sulfide, ammonia and light hydrocarbons is removed through line 68 and a hydrogenated furnace oil stream is removed through line 70 for recycle to line 12 and thermal cracker 14. The hydrogen in line 68 is purified and recycled.

The aromatic tar oil stream in line 26 is passed to delayed coker zone 72 where it is subjected to delayed coking conditions including a temperature in the range 775 to 900° F. (413 to 482° C.), generally, 800 to 875° F. (427 to 468° C.), preferably, and 825 to 850° F. (431 to 454° C.), most preferably. In one test, the tar oil stream comprised about 13 weight percent of the heavy gas oil feed to the process. The tar oil is highly aromatic and therefore suited for conversion to needle coke. It possesses an aromatic nature because of the absence of added hydrogen in thermal cracker 14. Not only does coker 72 produce commercially valuable needle coke but also passage of heavy oils to that unit keeps potential coke-formers out of pyrolysis zone 48. Any pressure sufficient to maintain furnace oil produced in coker 72 in the liquid state, such as between about 50 and 80psi (3.5 and 5.6 kg/cn$^2$), can be employed. Needle coke is removed from coker 72 through line 74. Coker liquid is removed from coker 72 through line 76 and passed to distillation zone 78, from which coker naphtha is removed through line 28 for passage to line 22 and naphtha hydrogenation zone 34 and from which coker furnace oil is removed through line 56 for passage to line 24 and furnace oil hydrogenation zone 62. About 10 to 20 percent of the coker furnace oil can be recycled to coker 72 through line 80. The coker naphtha and furnace oil streams are each in a highly unsaturated condition prior to hydrogenation. The coker naphtha sulfur content is less than about 50 ppm by weight and the needle coke produced contain about 0.6 to 0.7 weight percent sulfur.

An important observation concerning the process presented in the drawing is that only two product streams are obtained through line 74. In the process shown, the entire feed gas oil stream in line 10 is converted to naphtha, which is pyrolyzed, except that high boiling coke-formers are removed from the naphtha prior to pyrolysis and are converted to valuable needle coke.

We claim:

1. A process for converting gas oil whose components mostly boil between 650 and 1,000° F. to a pyrolysis product containing ethylene and ethane and to needle coke comprising thermally cracking said gas oil at a temperature between 750 and 1,000° F. without added hydrogen and without a catalyst to produce a thermally cracked product including cracked naphtha whose components mostly boil within the range 80 to 450° F., cracked furnace oil and aromatic tar oil having components boiling within the range 800 to 1,000° F., delay coking said tar oil at a temperature between 775 and 900° F. to produce needle coke, coker furnace oil, and coker naphtha, passing a total naphtha stream including said coker naphtha and said cracked naphtha to a catalytic naphtha hydrogenation zone operated at a temperature between 500 and 850 ° F. to produce hydrogenated naphtha containing at least 10 volume percent of cycloparaffins, and passing said hydrogenated naphtha to a pyrolysis zone operated at a temperature between 1,300 and 2,300° F. for a residence time between 0.05 and 2 seconds without added hydrogen and without a catalyst for conversion to a pyrolysis product including ethylene and ethane, wherein the once-through yield of ethylene is more than twice the yield of ethane on a weight basis.

2. The process of claim 1 wherein said cracked furnace oil is catalytically hydrotreated and passed to said thermal cracking step.

3. The process of claim 1 when said coker furnace oil is catalytically hudrotreated and passed to said thermal cracking step.

4. The process of claim 1 wherein said hydrogenated naphtha contains at least 20 volume percent of cycloparaffins.

5. The process of claim 1 wherein said hydrogenated naptha contains at least 30 volume percent of cycloparaffins.

6. The process of claim 1 wherein the temperature in said naphtha hydrogenation zone is at least 50° F. lower than the temperature in said thermal cracking and coking steps.

7. The process of claim 1 wherein said total naphtha stream contains more than 35 volume percent of olefins plus aromatics.

8. The process of claim 1 wherein said hydrogenated naphtha contains less than 5 volume percent of olefins plus aromatics.

9. The process of claim 1 wherein said hydrogenated naphtha contains less than 10 ppm by weight of sulfur.

10. The process of claim 1 wherein a sulfur compound is added to the hydrogenated naphtha in an amount to increase the sulfur content based on said hydrogenated naphtha to more than 20 ppm by weight.

11. The process of claim 1 wherein the once-through ethylene yield in said pyrolysis product is more than three times the ethane yield, on a weight basis.

12. The process of claim 1 wherein the once-through ethylene yield in said pyrolysis product is more than four times the ethane yield, on a weight basis.

13. The process of claim 1 wherein a stream containing paraffins from the $C_2$ to $C_5$ group and containing less than 10 volume percent of cycloparaffins is also passed to said pyrolysis zone.

14. The process of claim 1 wherein in said naphtha hydrogenation zone not more than 20 volume percent of said total naphtha stream is converted to material boiling below the IBP of said total naphtha stream prior to hydrogenation.

15. The process of claim 1 wherein the naphtha hydrogenation catalyst comprises tungsten and Group VIII metal.

16. The process of claim 1 wherein the naphtha hydrogenation catalyst comprises molybdenum and Group VIII metal.

17. The process of claim 1 wherein the naphtha hydrogenation catalyst comprises tungsten and molybdenum and Group VIII metal.

* * * * *

UNITED STATES PATENT OFFICE

CERTIFICATE OF CORRECTION

Patent No. 4,138,325 Dated February 6, 1979

Inventor(s) H. Beuther, J. D. McKinney and H. E. Swift

It is certified that error appears in the above-identified patent and that said Letters Patent are hereby corrected as shown below:

COL. 2, line 35, "1,300 and 2,300°C.)" should read --1,300 and 2,300°F. (704 and 1,260°C.)--

COL. 2, line 36, "most preferably" should read --preferably, and between about 1,430 and 1,850°F. (777 and 1,010°C.), most preferably.--

COL. 10, line 20, after "obtained" insert --; the stream of ethylene and other pyrolysis products passing through line 54 and the needle coke--

Signed and Sealed this

*Fourth* Day of *December 1979*

[SEAL]

*Attest:*

SIDNEY A. DIAMOND

*Attesting Officer*

*Commissioner of Patents and Trademarks*